United States Patent [19]

Mozley

[11] 4,123,364

[45] Oct. 31, 1978

[54] CYCLONE CONSTRUCTION AND FIXING

[75] Inventor: Richard H. Mozley, Falmouth, England

[73] Assignee: National Research Development Corporation, London, England

[21] Appl. No.: 782,295

[22] Filed: Mar. 28, 1977

[30] Foreign Application Priority Data

Apr. 2, 1976 [GB] United Kingdom ..... 13527/76

[51] Int. Cl.[2] ..... B04C 5/28

[52] U.S. Cl. ..... 210/512 M; 239/470; 239/536

[58] Field of Search ..... 239/403, 468, 470, 536; 210/512 R, 512 M

[56] References Cited

U.S. PATENT DOCUMENTS

| | | | |
|---|---|---|---|
| 2,671,560 | 3/1954 | Fontein et al. | 210/512 M |
| 2,809,567 | 10/1957 | Woodruff | 210/512 R X |
| 2,816,658 | 12/1957 | Braun et al. | 210/512 R UX |
| 2,897,972 | 8/1959 | Cannon | 210/512 R |
| 3,034,647 | 5/1962 | Giesse | 210/512 R X |
| 3,543,931 | 12/1970 | Rastatter | 210/512 M |
| 3,902,601 | 9/1975 | Townley | 210/512 R X |

*Primary Examiner*—Robert W. Saifer

*Attorney, Agent, or Firm*—Cushman, Darby & Cushman

[57] ABSTRACT

A cyclone is assembled from a kit having a feed head, a frusto-conical body and an apex nozzle all held together under axial pressure, all being arranged as a push-fit into each other. Supplementary bodies and complementary feed heads, all still arranged as push-fits, allow cyclones to be built up from the basic kit to larger diameters. The cyclones are held together in an assembly under axial pressure between end plates and may be arranged in a circular configuration with a single connector at the center of the circle holding the plates within a desired distance of each other.

10 Claims, 6 Drawing Figures

CYCLONE CONSTRUCTION AND FIXING

Figure 1:
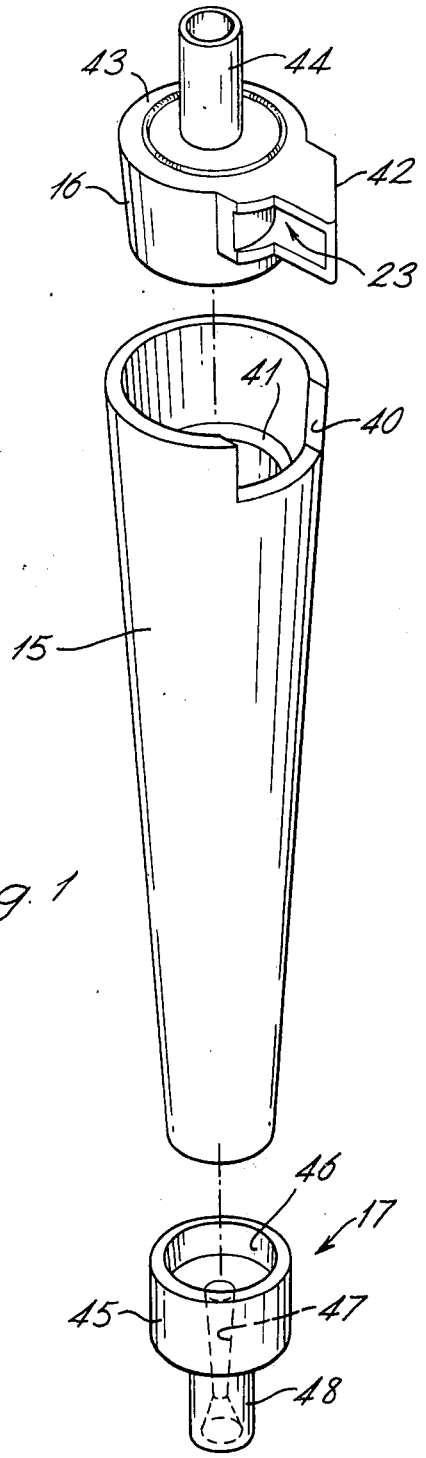

This invention relates to cyclone construction and fixing, in particular to a kit of parts for assembly to form a cyclone, to a cyclone thus assembled, and to a cyclone assembly including an arrangement for fixing one or more such cyclones.

The invention provides a kit of parts for assembly to form a cyclone, a kit comprising an apex nozzle, a frusto-conical member whose narrower end is capable of sealing engagement with the apex nozzle when the member and nozzle are pressed together axially, and a feed head comprising a tangential inlet and an axially extending tube and capable of sealing engagement when the member and the feed head are pressed together axially, such that when the apex nozzle and the frusto-conical member and the feed head are all held together under axial pressure the parts together can function as a cyclone. The material of the parts should combine hardness with some resilence, and therefore polyurethane is preferred for at least some of the parts.

The kit preferably further comprises at least one supplementary frusto-conical member whose narrower end is substantially identical to the sealable part of the feed head, and a respective feed head comprising a tangential inlet and an axially extending tube and capable of sealing engagement with the wider end of the supplementary frusto-conical member when the supplementary frusto-conical member and the respective feed head are pressed together axially, such that when the apex nozzle and the frusto-conical member and the supplementary frusto-conical member and the respective feed head are all held together under axial pressure the held parts together can function as a cyclone. Thus, a cyclone could be built up from the kit to any desired internal diameter at the feed head end. The invention extends to a cyclone comprising parts held together from a kit as set forth above.

Preferably the apex nozzle has an integral protruding flexible spigot internally continuing the frustum towards its apex. The spigot is optionally protected by a relatively stout skirt, which is preferably integral with the apex nozzle.

The invention further provides a cyclone assembly comprising a cyclone as set forth above, and further comprising two end plates and a connector for retaining the end plates within a desired distance from each other, the cyclone being held together under pressure between the end plates. The assembly may yet further comprise one or more additional cyclones as set forth above, all held together under pressure between the end plates. Preferably, the connector comprises a single rod generally parallel to, and generally centrally positioned with respect to, the cyclones.

The assembly may contain cyclones held with their axes generally parallel and perpendicular to the end plates, which they intersect at points all lying on a circle. Said points may, alternatively, lie on two or more concentric circles. The center of the circle(s) preferably coincides with said single rod. The end plate contacting the feed heads may be profiled so as to retain the tangential inlets in a fixed orientation, e.g., an orientation which ensures that no inlet is obstructed by a neighboring feed head.

Alternatively, the connector may comprise at least one clamping member hinged relative to one of the end plates and capable of applying force on the other end plates tending to retain the end plates together. Preferably, the resultant line of the force applied by all the clamping members is generally parallel to, and generally centrally positioned with respect to, the cyclones.

Figure 1A:
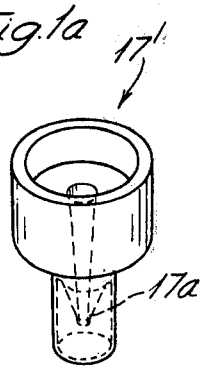
Figure 2:
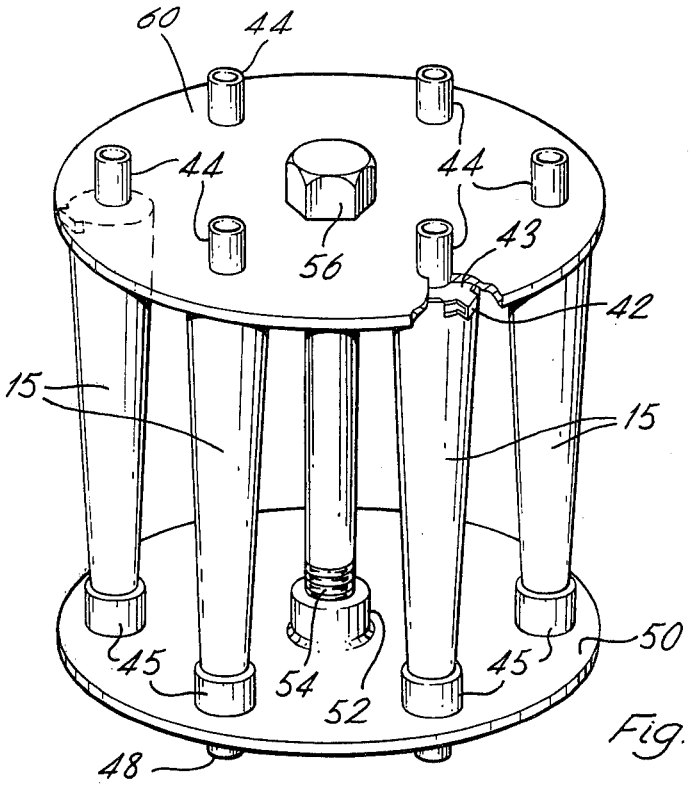
Figure 3:
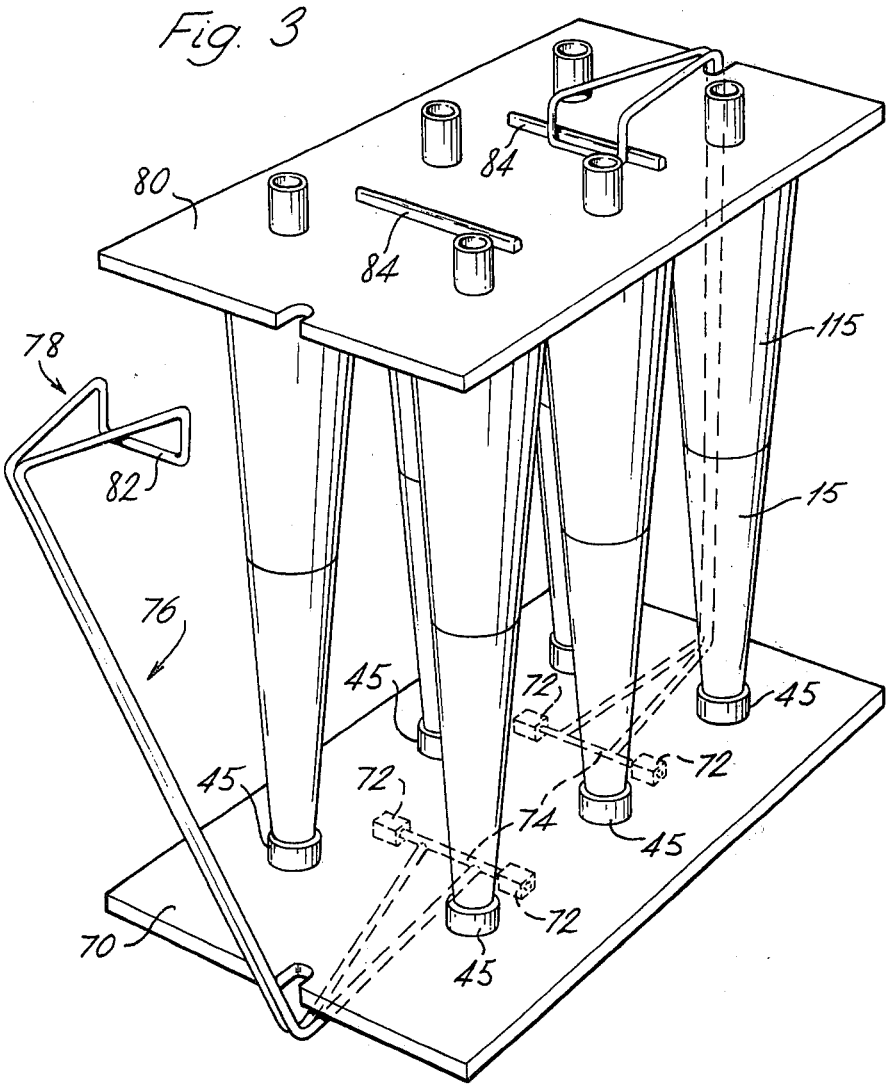
Figure 4:
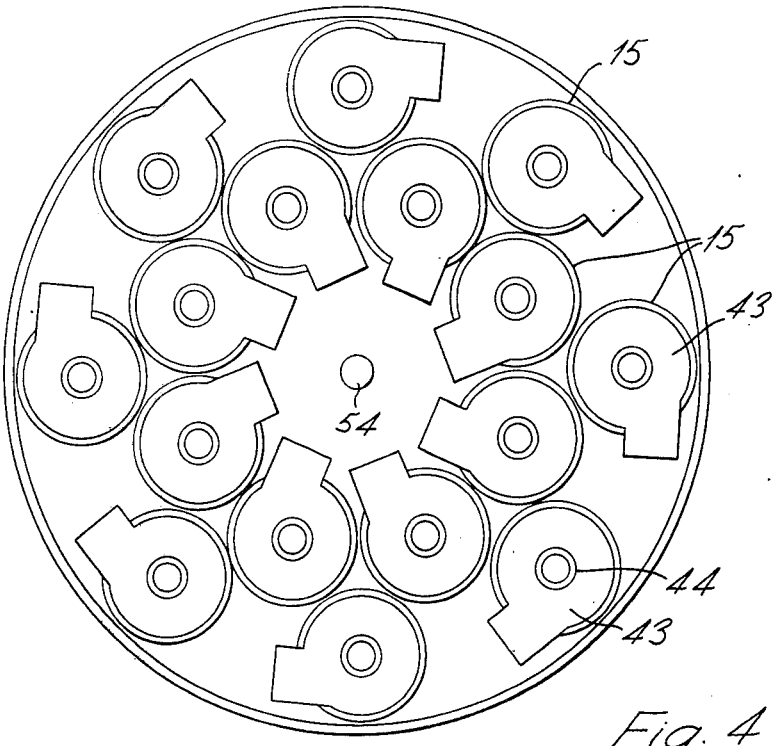
Figure 5:
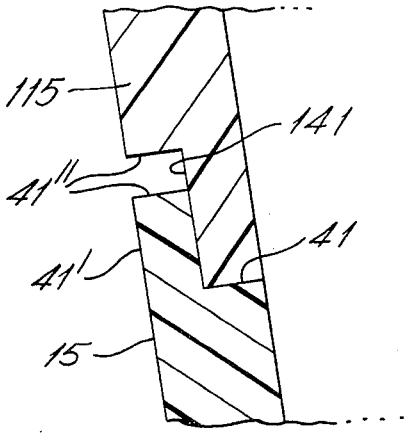

The invention will now be described by way of example with reference to the accompanying drawings in which:

FIG. 1 shows a kit of parts according to the invention,

FIG. 1*a* is a perspective view of a variation of the apex nozzle shown in FIG. 1, FIG. 2 shows a cyclone assembly according to the invention, FIG. 3 shows a different cyclone assembly but also according to the invention, FIG. 4 shows in plan (with part removed for clarity) a cyclone assembly according to the invention, and FIG. 5 shows a detail to an enlarged scale of parts of a kit according to the invention.

In FIG. 1, a kit of parts consists of an apex nozzle 17, a frusto-conical member 15 and a feed head 16, all of hard polyurethane, a material displaying an ideal combination of hardness and resilience. The apex nozzle 17 has a generally cylindrical body 45 having a well 46 at its upper end into which the member 15 is a push-fit. Internally, the apex nozzle 17 has a converging, then diverging passage 47 leading to an outlet formed in a projection 48 of the apex nozzle 17.

A downwardly facing external step or shoulder (not shown) may be provided towards the upper end of the member 15. The feed head 16 could be clamped to the member 15 by way of pressure transmitted through a plate pressing down on 16 and a plate pressing upwardly on the step or shoulder; these plates could define a feed box, which could replace a conventional feed manifold.

An alternative (and, indeed, preferred) apex nozzle 17' is shown alongside the first-mentioned apex nozzle. The apex nozzle 17' is constructed of polypropylene, a somewhat soft and resilient material. The apex outlet 17*a* of the nozzle is formed as a thin-walled, and hence slightly flexible, spigot, the walls of which taper down to a fraction of a millimeter thick. Particles of grit can thus sometimes be forced through the outlet 17*a* even if nominally oversize, thus simplifying the maintenance of the cyclone.

An alternative vortex finder cap (now shown) to the illustrated cap 16 has a relatively large converging inlet 23. This not only modifies the flow pattern of slurry entering the cyclone but its size also reduces the chance of blockage, thus again simplifying maintenance. In practice, the loss in senstivity attributable to the extra cross-section of the inlet is small and outweighed by the maintenance benefit.

The member 15 is cut away at its upper end to form a circumferential shoulder 41.

The feed head 16 of generally conical shape and has a hollow open protrusion 42 providing a vortex inlet 23 complementary to the recess 40. The feed head 16 is a push-fit into the member 15. When pushed home, the feed head 16 is seated on the shoulder 41 of the member 15 and, also, the upper plane surface 43 of the feed head 16 is level with the upper edge of the member 15.

The feed head 16 has a tubular upward extension 44 which can accommodate a vortex finder. The parts 17, 15, 16 when assembled thus form a cyclone of great simplicity and affording easy construction and dismantling.

A supplementary frusto-conical member (not shown) could be provided, with its own feed head of corresponding size, all again being of hard polyurethane. This supplementary member would, at its smaller end, be the same as those parts of the feed head 16 which engage the member 15. Thus, the supplementary member would be a push-fit into the member 15 and would normally have the same cone angle. The corresponding feed head would be a larger, but otherwise identical, replica of the feed head 16. Thus, when the apex nozzle 17, the member 15, the supplementary member and the corresponding feed head are all pushed together, they will fit together to form a cyclone having an inlet of larger internal diameter than formerly, yet utilising most of the parts of the former cyclone.

The kit can have any number of supplementary members in a series, with a corresponding feed head in each case, enabling a cyclone of any desired internal inlet diameter to be built up by simple push-fitting.

A cyclone assembled from a kit is advantageously held together by a pressure applied from one end directed to the other end. FIG. 2 shows an embodiment of this arrangement. Six assembled kits according to FIG. 1 are mounted on a circular bottom plate 50, apertured centrally and at six equally circumferentially spaced positions. The apertures are just large enough to accommodate the projections 48 (of the apex nozzles 17); thus the apex nozzles are seated on the bottom plate 50 on their shoulders formed between the projections 48 and the cylindrical bodies 45.

Welded to the center of the bottom plates in an internally threaded collar 52. A threaded bolt 54 engages the collar 52, and terminates at its upper end in a hexagonal head 56.

A circular top plate 60 is apertured centrally and at six equally circumferentially spaced positions. The six apertures each just accommodate the tubular upward extensions 44 (of the feed head 16) and the top plate 60 rests on the plane surfaces (43, hidden in this Figure). The central aperture freely accommodates the bolt 54.

The head 56 of the bolt 54 is turned until the top and bottom plates are retained within the desired distance of each other. In this way, the six cyclones are held together under any desired pressure applied from the top plate to the bottom plate. The bolt 54 and all the cyclone axes are parallel to each other. The circular configuration is preferable for resisting the internal pressure within the cyclones.

In FIG. 3, a different embodiment of cyclone assembly is shown. Six assembled cyclones are present, and these consist of the FIG. 1 kit (including the member 15) with the supplementary member (shown as 115) and corresponding feed head hereinbefore discussed.

The six cyclones are arranged in two parallel banks of three. The six cylindrical bodies 45 rest on a rectangular bottom plate 70 having six apertures, each accommodating one of the projections (48 hidden in the Figure by the plate 70), analogously to FIG. 2.

The corresponding feed head are of the same proportions (though of larger dimensions) as the feed head 16 of FIG. 1, and, analogously to FIG. 2, the upper plane surfaces of the feed head support a rectangular top plate 80 having two parallel banks of three apertures, each aperture accommodating a respective tubular upward extension. The six cyclones thus are all retained vertically.

The bottom and top plates 70, 80 bound a cuboidal volume which is sealed by four vertical rectangular plates (not shown). In use, matter to be sorted is pumped into the cuboidal volume under pressure and thus finds itself injected under pressure into the feed heads of the cyclones; thereafter the matter is sorted and is ejected as appropriate through the vortex finders or apices, as is conventional for cyclones.

The top plate 80 is connected with the bottom plate 70 as follows. Two pairs of sockets 72 are welded to the underside of the bottom plate 70 to receive a respective hingepin 74 of a clip 76 which can rotate about the line joining the sockets 72. Each clip 76 has a loop 78 at one end including a downwardly directed contact arm 82 which, because of the resilience of the clip 76, as a whole, bears downwardly on the top of the top plate 80. To retain the contact arm 82 in its "pressing" mode, a small retaining ledge 84 is provided over which the arm 82 can, however, when necessary, be pulled to release the clip 76.

It will be seen that the clips together act to clamp the top and bottom plates together along a resultant line of force parallel to the six cyclones and centrally positioned with respect to them.

FIG. 4 is a plan of a cyclone assembly somewhat similar to that of FIG. 2. The top plate 60 is removed for clarity but the bolt 54 is shown. The axes of all the cyclones are parallel and perpendicular to the end plate 60 (when in position). The axes all intersect the end plate at points lying on two concentric circles, whose center coincides with the bolt 54. The top plate 60 is so profiled on its lower surface that it will only sit properly when all the feed heads are in the orientation shown, which is calculated to ensure that no inlet is obstructed by a neighboring feed head.

FIG. 5 shows a detail of parts of a cyclone which is part of the assembly shown in FIG. 3. The frustoconial member 15 is a push fit into the supplementary member (also frustoconical) 115, and clamping pressure therebetween is transmitted by way of the shoulder 41 on the member 15. The complementary flange 141 of the member 115 is deeper than the rim 41' of the member 15 by about 0.1mm so that only the shoulder 41, and not the additional areas 41'', takes the clamping pressure. This helps to ensure that the inner frustoconical surface of the cyclone is as smooth as practicable having regard to the fact that a joint is present. If the surface were not smooth, a good vortex might fail to be formed in use. A like arrangement is also possible between the feed head and the contiguous frustoconical member.

I claim:

1. A kit of parts for assembly to form a cyclone, said kit comprising:

an apex nozzle; said apex nozzle including an annular body having an axially outwardly projecting, flexible spigot; a throughbore extending axially through the annular body and flexible spigot; and an annular skirt formed integrally on said body, said skirt circumferentially surrounding said flexible spigot, with radial spacing therefrom, and extending axially somewhat further than said flexible spigot;

an internally frusto-conical tubular member having a narrower end capable of sealing engagement with the apex nozzle when these two parts are pressed together axially;

a feed head, comprising:

means providing a tangential inlet, and an axially extending tube;

the axially extending tube being capable of sealing engagement with said tubular member when the tubular member and feed head are pressed together axially, such that when the apex nozzle, tubular member and feed head are all serially pressed together, these three parts together can function as a cyclone, the throughbore of the annular body frustoconically tapering so as to have a portion contiguous with said internally frusto-conical tubular member and which forms a substantially continuous internal extension thereof when these two parts are pressed together axially.

2. The kit of parts of claim 1, wherein:

the feed head and tubular member are made of rigid polyurethane and the apex nozzle is made of relatively softer, flexible polyprophylene.

3. A cyclone assembly, comprising:

(a) a plurality of individual cyclones, arranged in a ring each comprising:

(i) an apex nozzle including a throughbore;

(ii) an internally frusto-conical tubular member having a narrower end and a wider end, the narrower end being in engagement with said apex nozzle; and (iii) a feed head, including: means providing a tangential inlet; and an axially extending tube, the axially extending tube being in engagement with the wider end of said tubular member;

(b) two opposite end plates, one bearing against all the apex nozzles and the other bearing against all the feed head; and (c) connector means bearing against both opposite end plates and applying pressure thereto in a sense to draw the respective apex nozzles, internally frusto-conical members and feed heads axially together and to maintain respectively sealed communication from the respective of said tangential inlets, through the respective of said axially extending tube and the respective of said internally frusto-conical members to the respective of said throughbores of the respective of said apex nozzles said connector means being constituted by a single, tightenable rod member extending between said end plates within the ring.

4. The cyclone assembly of claim 3, wherein:

one said end plate is integrally centrally provided with an internally threaded nut and the other said end plate is centrally provided with a hole; and wherein said rod member is constituted by a bolt which is inserted through said hole and threaded into said nut.

5. The cyclone assembly of claim 3, wherein:

the tangential inlets of the cyclones lie between the two end plates and the throughbores of the apex nozzles are disposed to discharge axially beyond the end plates.

6. The cyclone assembly of claim 3, wherein:

the cyclones have longitudinal axes all parallel to one another and perpendicular to said end plates, and said plurality of cyclones is arranged in a circular cylindrical pattern with said rod member extending along the centerline thereof.

7. The cyclone assembly of claim 6, wherein:

the one of said end plates which is in contact with said feed heads has means defining a profiled surface with a circumferentially discontinuous superficial characteristic repeated proximate each feed head, and which will accommodate drawing and maintaining by said connector means, as aforesaid, only when all said feed heads are angularly disposed at a preselected orientation relative to the said superficial characteristic associated therewith, so that the cyclone assembly may be easily assembled to have a preselected pattern of inlet configuration.

8. The cyclone assembly of claim 3, wherein:

the cyclones have longitudinal axes all parallel to one another and perpendicular to said end plates, and said plurality of cyclones is arranged in a circular cylindrical pattern of two concentric circular imaginary cylinders, with said rod member extending along the centerline thereof.

9. A cyclone assembly, comprising:

(a) a plurality of individual cyclones, each comprising:

(i) an apex nozzle including a throughbore;

(ii) an internally frusto-conical tubular member having a narrower end and a wider end, the narrower end being in engagement with said apex nozzle; and (iii) a feed head, including: means providing a tangential inlet; and an axially extending tube, the axially extending tube being in engagement with the wider end of said tubular member;

(b) two opposite end plates, one bearing against all the apex nozzles and the other bearing against all the feed heads; and (c) connector means bearing against both opposite end plates and applying pressure thereto in a sense to draw the respective apex nozzles, internally frusto-conical members and feed heads axially together and to maintain respectively sealed communication from the respective of said tangential inlets, through the respective of said axially extending tube and the respective of said internally frusto-conical members to the respective of said throughbores of the respective of said apex nozzles, the connector means being constituted by at least one clamp member that is hinged to one of said end plates and which clamps against the other of said end plates.

10. The cyclone assembly of claim 9, wherein:

there are a plurality of said clamp members distributed about the periphera of the respective end plates, with a result that the resultant line of the force applied by all these clamping members is generally parallel to, and generally centrally positioned with respect to, the plurality of cyclones.

* * * * *